US006953647B2

(12) United States Patent
Kimura et al.

(10) Patent No.: US 6,953,647 B2
(45) **Date of Patent: *Oct. 11, 2005**

(54) ELECTROPHOTOGRAPHIC PHOTOSENSITIVE MEMBER, PROCESS FOR PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Tomohiro Kimura, Kawasaki (JP); Yoichi Kawamorita, Chigasaki (JP); Shintetsu Go, Yokohama (JP); Hideaki Nagasaka, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/200,812

(22) Filed: Jul. 22, 2002

(65) Prior Publication Data

US 2003/0013031 A1 Jan. 16, 2003

Related U.S. Application Data

(62) Division of application No. 09/203,509, filed on Dec. 1, 1998, now abandoned.

(30) Foreign Application Priority Data

Dec. 1, 1997 (JP) ..... 9-33-386

(51) Int. Cl.[7] ..... G03G 5/10
(52) U.S. Cl. ..... 430/127; 430/69
(58) Field of Search ..... 430/127, 131, 430/56, 57.1, 60, 64, 65, 69; 148/275, 247; 428/472.2

(56) References Cited

U.S. PATENT DOCUMENTS

| | | | | | |
|---|---|---|---|---|---|
| 4,091,145 | A | | 5/1978 | Endo et al. | 428/546 |
| 4,422,886 | A | | 12/1983 | Das et al. | 148/31.5 |
| 4,786,336 | A | | 11/1988 | Schoener et al. | 148/247 |
| 4,936,948 | A | | 6/1990 | Ohki et al. | 156/645 |
| 5,008,167 | A | | 4/1991 | Yu | 430/56 |
| 5,336,576 | A | * | 8/1994 | Miyamoto et al. | 430/73 |
| 5,397,666 | A | | 3/1995 | Fukuda et al. | 430/65 |
| 5,561,015 | A | | 10/1996 | Yoshida et al. | 430/58 |
| 5,643,703 | A | | 7/1997 | Daimon et al. | 430/78 |
| 5,875,375 | A | * | 2/1999 | Ohmori et al. | 399/159 |
| 5,903,803 | A | | 5/1999 | Kawai et al. | 399/116 |
| 6,248,490 | B1 | | 6/2001 | Suzuki et al. | 430/78 |
| 6,432,603 | B1 | * | 8/2002 | Kimura et al. | 430/131 |

FOREIGN PATENT DOCUMENTS

| | | |
|---|---|---|
| EP | 0743561 A2 | 11/1996 |
| JP | 012733 | 1/1979 |
| JP | 029051 | 2/1982 |
| JP | 062056 | 4/1982 |
| JP | 014841 | 1/1983 |
| JP | 029852 | 1/1989 |
| JP | 007070 | 1/1990 |
| JP | 034964 | 2/1993 |
| JP | 09-511548 | 11/1997 |

OTHER PUBLICATIONS

US Patent & Trademark Office English Translation JP 57–62056, Apr. 1982.
CRC Handbook of Ch mistry & Physics, 48$^{th}$ Ed., R. W st t al., The Chemical Rubb r Co., 1967, B–149, B–150.
Database WP1, Section Ch, Week 9130, Derwent Publ., AN91–219, 149, XP 002096084, for JP3–140965, 6;91.

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member is disclosed which has an aluminum substrate and a photosensitive layer. The substrate contains aluminum, oxygen and titanium, or aluminum, oxygen and zirconium, at the surface portion on the side of the photosensitive layer. Also, a process for producing the electrophotographic photosensitive member, and a process cartridge and an electrophotographic apparatus using the photosensitive member are disclosed.

6 Claims, 2 Drawing Sheets

ELECTROPHOTOGRAPHIC PHOTOSENSITIVE MEMBER, PROCESS FOR PRODUCING ELECTROPHOTOGRAPHIC PHOTOSENSITIVE MEMBER, PROCESS CARTRIDGE, AND ELECTROPHOTOGRAPHIC APPARATUS

CROSS-REFERENCE TO RELATED APPLICATIONS

This application is a division of application Ser. No. 09/203,509, filed Dec. 1, 1998, now abandoned.

BACKGROUND OF THE INVENTION

1. Field of the Invention

This invention relates to an electrophotographic photosensitive member, a process for producing the electrophotographic photosensitive member, and a process cartridge and an electrophotographic apparatus which have the photosensitive member.

2. Related Background Art

Electrophotographic photosensitive members are constituted basically of a photosensitive layer on which a latent image is formed by electrostatic charging and exposure to light and a substrate on which the photosensitive layer is provided.

Meanwhile, electrophotographic photosensitive members are required to have sensitivities, electric properties and optical characteristics in accordance with electrophotographic processes applied.

They are also required to have an environmental stability in any environment of from low temperature/low humidity to high temperature/high humidity which is good enough to enable them to perform well.

Faulty images are exemplified typically by image lines, black spots in white background areas, white spots in black background areas, background fog in white background areas, and also interference fringes caused by factors such as surface shape of substrates and uneven layer thickness of photosensitive members in the case of apparatus such as digital copying machines and laser beam printers in which exposure is effected using a light source having a single wavelength. Accordingly, in the manufacture of photosensitive members, some countermeasures must be taken in advance so that these faulty images do not occur.

As a factor having a great influence when such faulty images occur, there is the surface state of a substrate.

Substrates which are not treated at all after molding usually do not necessarily exhibit any surface state which is most suited for photosensitive members. Hence, problems caused by the untreated surface state may occur in many instances.

To solve such problems, methods of approach have hitherto been proposed, as exemplified by a method in which the surface of an aluminum substrate is subjected to chromating to form a chromated chemical conversion coating, as disclosed in Japanese Patent Application Laid-Open Nos. 54-12733 and 57-62056; a method in which a boehmite coating is formed on the surface of an aluminum substrate, as disclosed in Japanese Patent Application Laid-Open Nos. 58-14841 and 64-29852; and a method in which the surface of an aluminum substrate is oxidized by high-temperature treatment to form an oxidized film, as disclosed in Japanese Patent Application Laid-Open No. 57-29051.

With regard to, e.g., the method of chromating, substrates having a certain degree of performance can be obtained.

However, since the treating solutions contain chromium, it is very difficult to dispose of waste liquor, and also this is not preferable in view of environmental safety.

With regard to the boehmite treatment, the crystal state of the surface can not be said to be suited for substrates of electrophotographic photosensitive members. They can be effective to a certain degree, with regard to electrophotographic performance, with regard to images, no satisfactory image quality has been achieved because the surface structure and shape are unsuited. Thus, under existing circumstances, those satisfying all performances have not been available.

What is aimed by the above surface treatment is that the film formed on the substrate surface prevents any non-uniformity from being caused in electrophotographic performances and images by electric charges injected locally from the substrate to the photosensitive layer.

As a method of preventing such local charge injection so as to prevent faulty images, a method is available in which the surface of an aluminum substrate is subjected to anodizing to provide a layer of aluminum oxide (e.g., Japanese Patent Application Laid-Open Nos. 2-7070 and 5-34964).

This method is a good method in order to maintain to attain such an aim. However, in order to form the layer uniformly without causing any uneven layer thickness on the substrate surface, the layer must be formed in a certain larger thickness, and a thickness of about 5 or 6 $\mu$m or more under usual conditions for its formation. Hence, the layer must be formed in a much larger thickness than the thickness actually required as a charge injection blocking layer, resulting in an increase in cost.

SUMMARY OF THE INVENTION

Accordingly, an object of the present invention is to provide a electrophotographic photosensitive member having good electrophotographic properties that causes no faulty images in any environment of from low temperature/low humidity to high temperature/high humidity and also may cause less potential variations, a process by which such an electrophotographic photosensitive member can be produced with ease at a low cost and stably, and a process cartridge and an electrophotographic apparatus which have the photosensitive member.

As a result of studies made in order to solve the problems discussed above, the inventors have discovered that it is very effective to form on the substrate an insoluble coating or film with specific composition by applying specific chemical conversion treatment to the substrate surface, i.e., by chemical reaction between an aluminum substrate used in the electrophotographic photosensitive member and an aqueous acid solution containing a specific metal element, without use of any electrical external force. This is effective in view of the advantages realized in that an electrophotographic photosensitive member having excellent properties can be obtained, and the cost and environment are very much less adversely affected, and further the production apparatus can be made simpler than by anodizing.

That is, the present invention provides an electrophotographic photosensitive member comprising an aluminum substrate and a photosensitive layer provided thereon;

the substrate containing aluminum, oxygen and titanium, or aluminum, oxygen and zirconium, at its surface portion on the side of the photosensitive layer.

The present invention also provides a process for producing an electrophotographic photosensitive member, comprising the steps of;

subjecting an aluminum substrate to chemical conversion with an aqueous acid solution containing a salt of titanium or a salt of zirconium; and forming a photosensitive layer.

The present invention still also provides a process cartridge and an electrophotographic apparatus which have the electrophotographic photosensitive member described above.

DESCRIPTION OF THE PREFERRED EMBODIMENTS

Figure 1:
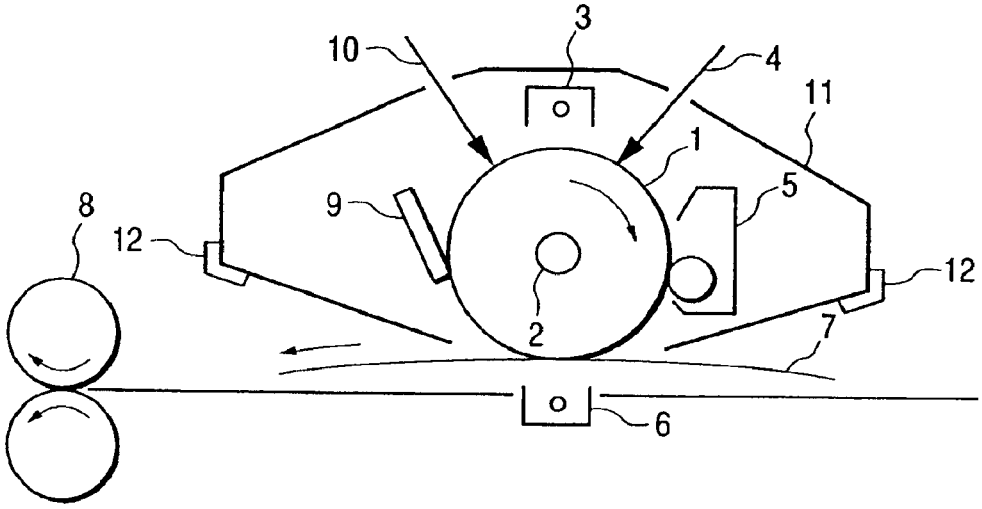
FIG. 1 schematically illustrates an example of the construction of an electrophotographic apparatus having a process cartridge having the electrophotographic photosensitive member of the present invention.

The electrophotographic photosensitive member of the present invention has an aluminum substrate and a photosensitive layer provided thereon, and the substrate contains aluminum, oxygen and titanium, or aluminum, oxygen and zirconium, at its surface portion on the side of the photosensitive layer.

The above electrophotographic photosensitive member can be obtained by subjecting the aluminum substrate to chemical conversion with an aqueous acid solution containing a salt of titanium or a salt of zirconium, and thereafter forming the photosensitive layer.

The chemical conversion referred to in the present invention is treatment where a substrate is brought into contact with a specific solution to form on the substrate a coating having a specific composition, without applying any electrical external force as in anodizing.

Metals of the metal salts used in the present invention are titanium and zirconium. The aluminum substrate having a chemical conversion coating of the present invention in which any one of titanium and zirconium is present together with aluminum and oxygen has very good properties as a substrate for electrophotographic photosensitive members.

The salt of titanium and the salt of zirconium may preferably be fluorine compounds. The salt of titanium may include titanium hydrofluoric acid, a sodium salt, potassium salt or ammonium salt thereof, and titanium sulfate. The salt of zirconium may include zirconium potassium fluoride and zirconium sulfate.

The aqueous acid solution may preferably contain the metal salt in a concentration of from 0.01 to 2 g/liter as weight of metal.

The aqueous acid solution may also preferably contain fluorine ions in a concentration ranging from 0 to 10 g/liter. Within this range, etching reaction may appropriately take place on the substrate surface and a uniform coating can be formed with ease.

The aqueous acid solution of the present invention may preferably have a pH adjusted within the range of from 1.0 to 5.5 using ammonia or sodium hydroxide. If it has a pH below 1.0, the etching reaction may take place violently which makes it difficult to obtain a good coating. If it has a pH above 5.5, the coating may be formed at so low a rate that only a thin coating can be obtained, making it difficult to obtain a remarkable effect of the present invention.

In the present invention, in view of an advantage that the reaction takes place stably, the aqueous acid solution may preferably be heated to 30 to 90° C. when used.

As methods for bringing the substrate into contact with the aqueous acid solution, either a method of dipping or spraying may be used. Dipping is preferred in view of production efficiency.

The substrate having been subjected to the chemical conversion is used after it is washed and dried.

The composition of the substrate surface portion in the present invention is measured by the Auger electron ray spectroscopy, and is defined to be the one within the range of from the uppermost surface to a depth of 50 Å ($5\times10^{-3}$ $\mu$m).

In the present invention, the titanium or zirconium may be contained in an amount ranging from 4 to 100 atom %.

The chemical conversion coating containing titanium or zirconium, formed on the substrate surface may preferably have a total layer thickness of 1 $\mu$m or smaller, and more preferably 50 Å ($5\times10^{-3}$ $\mu$m) or larger. If the coating is in a layer thickness larger than 1 $\mu$m, electric charges become difficult to discharge and tend to cause an increase in residual potential or cause ghost. If it is in a layer thickness smaller than 50 Å ($5\times10^{-3}$ $\mu$m), the remarkable effects of the present invention maybe obtained with difficulty.

In the present invention, in view of corrosion resistance and adhesion of coating films, the aqueous acid solution may preferably further contain a phosphoric acid, a phosphate, a tannin or a tannic acid.

The phosphoric acid and phosphate may include phosphoric acid or a sodium, potassium or ammonium salt thereof, and pyrophosphoric acid, tripolyphosphoric acid, hexametaphosphoric acid or a sodium salt or potassium salt thereof. Also, organic phosphoric acid compounds may be used as exemplified by phytic acid, nitrodiethanolethylene phosphonic acid, 2-hydroxyethylmethacryl-1-acid phosphonic acid, 2-ethylhexyl acid phosphonic acid and ethane-1-hydroxy-1,1-diphosphonic acid.

The phosphoric acid or phosphate in the aqueous acid solution may preferably be in a concentration ranging from 0.05 to 50 g/liter in terms of phosphate ions. Within this range, an especially uniform and good chemical conversion coating can be formed and also the treating solution can have an especially good stability.

The tannin or tannic acid may include quebracho tannin, depside tannin, Chinese tannic acid, Turkish tannic acid, hamamelitannic acid, chebulinic acid, sumac tannin, Chinese gallotannin and ellagitannin.

The tannin or tannic acid in the aqueous acid solution may preferably be in a concentration ranging from 0.1 to 10 g/liter.

In the present invention, the aqueous acid solution may preferably contain hydrofluoric acid, borofluoric acid, hydrosilicofluoric acid or a salt of any of these. These compounds have the function to etch the substrate surface when the substrate is subjected to chemical conversion, and hence a very uniform chemical conversion coating can be formed.

From the foregoing, it is preferable for the chemical conversion coating of the present invention to contain phosphorus and fluorine.

There are no particular limitations on the aluminum substrate so long as it comprises aluminum, which may include pure aluminum and aluminum alloys such as Al—Mn, Al—Mg, Al—Cu, Al—Si, Al—Mg—Si and Al—Cu—Si types. Stated more specifically, aluminum of 6000 types such as JIS A6063 and aluminum of 3000 types such as JIS A3003 may be used. There are also no particular limitations on its shape. It may preferably be in the form of a drum.

The photosensitive layer of the electrophotographic photosensitive member used in the present invention will be described below.

Constitution of the photosensitive layer in the present invention is grouped roughly into a single-layer type in which a charge-generating material and a charge-transporting material are contained in the same layer and a multi-layer type having a charge generation layer containing a charge-generating material and a charge transport layer containing a charge-transporting material.

An electrophotographic photosensitive member having the multi-layer type photosensitive layer will be described below.

The photosensitive layer may be constituted in the manner that the charge generation layer and the charge transport layer are layered on the substrate in this order or conversely the charge transport layer and the charge generation layer are layered in this order.

The charge transport layer is formed by coating a coating solution prepared by dissolving a charge-transporting material such as a polycyclic aromatic compound having a biphenylene, anthracene, pyrene or phenanthrene structure, a nitrogen-containing cyclic compound such as indole, carbazole, oxadiazole or pyrazoline, a hydrazone compound or a styryl compound in a resin having film forming properties, followed by drying.

The resin having film forming properties may include polyesters, polycarbonates, polystyrenes, polymethacrylates and polyarylates.

The charge transport layer may preferably have a layer thickness of from 5 to 40 $\mu$m, and preferably from 10 to 30 $\mu$m.

The charge generation layer is formed by coating a dispersion prepared by dispersing a charge-generating material such as an azo pigment such as Sudan Red or Dyan Blue, a quinone pigment such as pyrene, quinone or anthanthrone, a quinocyanine pigment, a perylene pigment, an indigo pigment such as indigo or thioindigo or a phthalocyanine pigment in a resin such as polyvinyl butyral, polystyrene, or polyvinyl acetate or acrylate, followed by drying, or formed by vacuum deposition of the above pigment.

The charge generation layer may preferably have a layer thickness of 5 $\mu$m or smaller, and more preferably from 0.1 to 3 $\mu$m.

The single-layer type photosensitive layer is formed by coating a coating fluid prepared by dispersing and dissolving the charge-generating material and the charge-transporting material in the resin, followed by drying.

Such a photosensitive layer may preferably have a layer thickness of from 5 to 40 $\mu$m, and more preferably from 10 to 30 $\mu$m.

In the present invention, a subbing layer functioning as a barrier and functioning as an adhesive may be provided between the support and the photosensitive layer. The subbing layer is formed by coating a solution prepared by dissolving casein, polyvinyl alcohol, nitro cellulose, ethylene-acrylic acid copolymer, alcohol-soluble polyamide, polyurethane or gelatin, following by drying.

The subbing layer may preferably have a layer thickness of from 0.1 to 3 $\mu$m.

In the present invention, a protective layer may be provided on the photosensitive layer.

The protective layer may be constituted of a material including polyester, polyacrylate, polyethylene, polystyrene, polybutadiene, polycarbonate, polyamide, polypropylene, polyimide, polyamide-imide, polysulfone, polyacrylic ether, polyacetal, phenol, acrylic, silicone, epoxy, urea, allyl, alkyd, butyral, phenoxy, phosphazene, acryl-modified epoxy, acryl-modified urethane and acryl-modified polyester resins.

The protective layer may preferably have a layer thickness of from 0.2 to 10 $\mu$m.

In the above respective layers, a lubricant such as polytetrafluoroethylene, polyvinylidene fluoride, fluorine type graft polymer, silicone type graft polymer, fluorine type block polymer, silicone type block polymer or silicone oil may be incorporated in order to improve cleaning performance and wear resistance.

Additives such as an antioxidant may further be added for the purpose of improving weatherability.

In the protective layer, conductive powder such as conductive tin oxide or conductive titanium oxide may be dispersed for the purpose of resistance control.

FIG. 1 schematically illustrates the construction of an electrophotographic apparatus having a process cartridge having the electrophotographic photosensitive member of the present invention.

In FIG. 1, reference numeral 1 denotes a drum type electrophotographic photosensitive member of the present invention, which is rotatingly driven around an axis 2 in the direction of an arrow at a given peripheral speed. The photosensitive member 1 is uniformly electrostatically charged on its periphery be a positive or negative, given potential through a primary charging means 3. The photosensitive member thus charged is then exposed to light 4 emitted from an exposure means (not shown) for slit exposure or laser beam scanning exposure. In this way, electrostatic latent images are formed successively on the periphery of the photosensitive member 1.

The electrostatic latent images thus formed are subsequently developed by toner by the operation of a developing means 5. The toner-developed images formed by development are then transferred successively by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 which has received the images is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. When the primary charging means 3 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, liquid-crystal printers and laser beam engravers.

The present invention will be described below in greater detail by giving Examples.

EXAMPLE 1

An aluminum cylinder of 29.92 mm in outer diameter, 28.5 mm in inner diameter and 254 mm in length was prepared.

An aqueous acid solution (trade name: PALCOAT 3753, available from Nihon Parkerizing Co., Ltd.; pH: 3.8) containing phytic acid as an organic phosphoric acid and titanium hydrofluoric acid and titanium ammonium fluoride as salts of metals was kept at a temperature of 40° C., and the above aluminum cylinder was immersed in this aqueous acid solution to cause chemical conversion for 1 minute. The cylinder was then washed with pure water, followed by air-drying. The chemical conversion coating thus formed was in a layer thickness of 200 Å.

Next, 4 parts by weight of oxytitanium phthalocyanine, 2 parts by weight of polyvinyl butyral resin (trade name: BX-1, available from Sekisui Chemical Co. Ltd.) and 34 parts by weight of cyclohexanone were dispersed for 8 hours by means of a sand mill, followed by addition of 60 parts by weight of tetrahydrofuran to make up a charge generation layer coating dispersion.

This dispersion was dip-coated on the aluminum cylinder having been subjected to chemical conversion, followed by drying with heating at 95° C. for 10 minutes to form a charge generation layer with a layer thickness of 0.2 $\mu$m.

Next, a solution prepared by dissolving 50 parts by weight of a triarylamine compound represented by the following formula and 50 parts by weight of bisphenol-Z polycarbonate resin in 400 parts by weight of monochlorobenzene was dip-coated on the charge generation layer, followed by drying with heating at 110° C. for 1 hour to form a charge transport layer with a layer thickness of 20 $\mu$m.

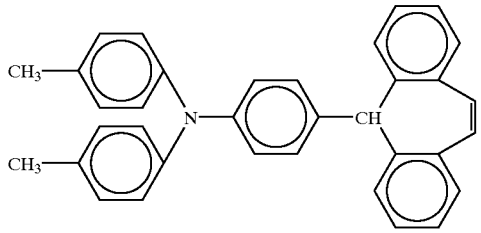

Figure 2:
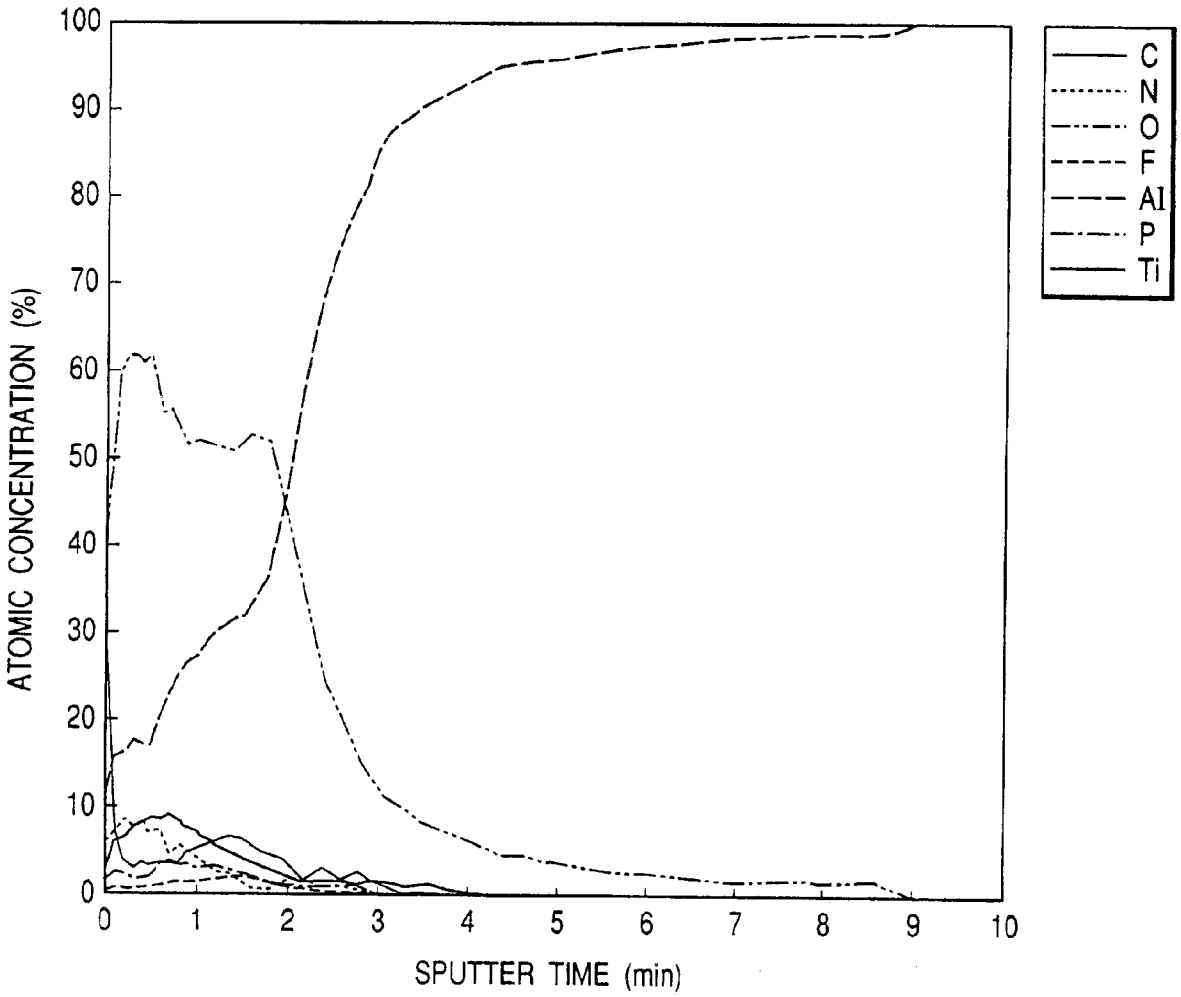
FIG. 2 is a graph showing compositional ratio of elements constituting the surface portion of a substrate of the electrophotographic photosensitive member of the present invention.

The surface portion of the substrate having been subjected to chemical conversion, washing and drying was examined by elementary analysis using a scanning Auger electron ray spectroscope while conducting argon ion etching from the uppermost surface in the depth direction of the substrate. As the result, aluminum, titanium and oxygen were detected as main constituent elements. Their graphic representation is given in FIG. 2. In the present Example, the relationship between depth and sputter time is 110 Å/min in terms of $SiO_2$. This value is appropriately changeable.

The compositional ratio of elements at the uppermost surface of the substrate and a depth of 50 Å from the uppermost surface is shown in Table 1 as elementary percentage regarding the amount of aluminum element as 100.

As can be seen from these results, the chemical conversion coating on the substrate surface comprises an oxidized aluminum coating in which titanium has been incorporated. As the result of analysis, nitrogen, fluorine, phosphorus and so forth are detected as other elements contained. These elements are considered to be those originally contained in the phosphoric acid and fluorine compound in the aqueous acid solution used when the chemical conversion is made, and incorporated in the chemical conversion coating.

Next, the electrophotographic photosensitive member obtained was left for 48 hours in an environment of normal temperature/normal humidity (23° C., 60% RH), high temperature/high humidity (32.5° C., 85% RH) or low temperature/low humidity (15° C., 10% RH), and thereafter set in a commercially available laser beam printer of a reverse development system to reproduce solid white images in each environment.

The state of background fog in the solid white images thus formed was visually evaluated. The results are shown in Table 2.

Simultaneously, values of dark-area potential and light-area potential were measured in each environment. The results are shown in Table 2.

EXAMPLE 2

An electrophotographic photosensitive member was produced in the same manner as in Example 1 except that a solution (trade name: PALCOAT 3756, available from Nihon Parkerizing Co., Ltd.; pH: 3.2) containing tannic acid, an ammonium salt and zirconium fluoride and zirconium sulfate as salts of metals was used as the aqueous acid solution for chemical conversion. Evaluation was made similarly. The results are shown in Tables 1 and 2. The chemical conversion coating was in a layer thickness of 150 Å.

EXAMPLE 3

An electrophotographic photosensitive member was produced in the same manner as in Example 1 except that a solution (trade name: PALCOAT 3753T, available from Nihon Parkerizing Co., Ltd.; pH: 3.2) containing phytic acid and containing zirconium hydrofluoric acid and zirconium ammonium fluoride as salts of metals was used as the aqueous acid solution for chemical conversion. Evaluation was made similarly. The results are shown in Tables 1 and 2. The chemical conversion coating was in a layer thickness of 180 Å.

EXAMPLE 4

An electrophotographic photosensitive member was produced in the same manner as in Example 1 except that a solution (trade name: ALUSURF 301N-1, available from Nihon Paint Co., Ltd.; pH: 4.0) containing phosphoric acid and containing zirconium fluoride and a sodium salt of zirconium hydrofluoric acid as salts of metals was used as the aqueous acid solution for chemical conversion. Evaluation was made similarly. The results are shown in Tables 1 and 2. The chemical conversion coating was in a layer thickness of 300 Å.

COMPARATIVE EXAMPLE 1

An electrophotographic photosensitive member was produced in the same manner as in Example 1 except that the chemical conversion was not carried out. Evaluation was made similarly. The results are shown in Table 2.

COMPARATIVE EXAMPLE 2

Ammonia water with a concentration of 0.3% was prepared, and this was heated to 95° C.

In this heated ammonia water, the same aluminum cylinder as that used in Example 1 and having not been subjected to chemical conversion was immersed to make surface treatment, followed by drying to form a boehmite coating on the cylinder surface.

An electrophotographic photosensitive member was produced in the same manner as in Example 1 except that this aluminum cylinder was used instead. Evaluation was made similarly. The results are shown in Table 2.

COMPARATIVE EXAMPLE 3

Chemical conversion was carried out by immersing an aluminum cylinder for 1 minute in, in place of the aqueous acid solution of the present invention, a chromium phosphate type solution for chemical conversion (trade name: ALUCHROME 3701, available from Nihon Parkerizing Co., Ltd.) kept at 30° C., containing neither titanium nor zirconium, to form a chromate type chemical conversion coating on the surface of the cylinder.

An electrophotographic photosensitive member was produced in the same manner as in Example 1 except that this aluminum cylinder was used instead. Evaluation was made similarly. The results are shown in Table 2.

TABLE 1

| | Percentage of the number of atoms of each element to the number of aluminum atoms (atom %) | | | | | | | |
|---|---|---|---|---|---|---|---|---|
| Measured at: | Aluminum | Titanium | Zirconium | Oxygen | Nitrogen | Fluorine | Phosphorus | Carbon |
| Example 1 | | | | | | | | |
| Uppermost surface: | 100 | 32.8 | — | 470 | 80.3 | 7.2 | 14.8 | 503.1 |
| 50 Å depth: | 100 | 64.2 | — | 389.6 | 63.4 | 6.7 | 13.4 | — |
| Example 2 | | | | | | | | |
| Uppermost surface: | 100 | — | 23.3 | 422.1 | — | 10.5 | 66.3 | 541.9 |
| 50 Å depth: | 100 | — | 10 | 185 | — | 8.8 | 9.1 | — |
| Example 3 | | | | | | | | |
| Uppermost surface: | 100 | — | 29.3 | 356.6 | 53.5 | 6.1 | — | 453.5 |
| 50 Å depth: | 100 | — | 51.6 | 320.7 | 43.1 | 4.8 | — | — |
| Example 4 | | | | | | | | |
| Uppermost surface: | 100 | — | 59 | 232.7 | 100 | 34 | 100 | 394.7 |
| 50 Å depth: | 100 | — | 95 | 916.7 | 20.8 | 8.3 | 45.8 | — |

Measuring device: A 670xi type scanning Auge electron spectroscope manufactured by ULVAC-PHI. INC.; electron probe diameter: 0.1 μm or smaller. An argon ion gun was used in etching.

TABLE 2

| | Evaluation on fog | | | Measurement potential (−V) | | | | | |
|---|---|---|---|---|---|---|---|---|---|
| | Normal temp./ normal humidity | High temp./ high humidity | Low temp./ low humidity | Normal temp./ normal humidity | | High temp./ high humidity | | Low temp./ low humidity | |
| | | | | Dark area | Light area | Dark area | Light area | Dark area | Light area |
| Example: | | | | | | | | | |
| 1 | A | A | A | 700 | 170 | 700 | 170 | 700 | 175 |
| 2 | A | A | A | 705 | 170 | 700 | 170 | 705 | 180 |
| 3 | A | A | A | 695 | 170 | 695 | 165 | 700 | 175 |
| 4 | A | A | A | 700 | 170 | 700 | 165 | 700 | 180 |

TABLE 2-continued

| | Evaluation on fog | | | Measurement potential (−V) | | | | | |
|---|---|---|---|---|---|---|---|---|---|
| | Normal temp./ normal humidity | High temp./ high humidity | Low temp./ low humidity | Normal temp./ normal humidity | | High temp./ high humidity | | Low temp./ low humidity | |
| | | | | Dark area | Light area | Dark area | Light area | Dark area | Light area |
| Comparative Example: | | | | | | | | | |
| 1 | C | B | C | 700 | 170 | 690 | 150 | 700 | 220 |
| 2 | C | B | C | 700 | 170 | 695 | 165 | 700 | 180 |
| 3 | B | B | C | 700 | 170 | 695 | 160 | 705 | 180 |

Evaluation
A: Excellent
B: Good
C: Poor

What is claimed is:

1. A process for producing an electrophotographic photosensitive member, comprising the steps of:

(a) subjecting an aluminum substrate to chemical conversion, without anodizing, with an aqueous acid solution containing a salt of titanium or a salt of zirconium; and (b) forming a photosensitive layer comprising a charge-generating material and a charge-transporting material on the chemically converted aluminum substrate by coating.

2. A process according to claim 1, wherein the salt of titanium and the salt of zirconium are fluorine compounds.

3. A process according to claim 1, wherein said aqueous acid solution has a pH of from 1.0 to 5.5.

4. A process according to claim 1, wherein said aqueous acid solution has a temperature of from 30° C. to 90° C.

5. A process according to claim 1, wherein said aqueous acid solution further contains at least one compound selected from the group consisting of a phosphoric acid, a phosphate, a tannin and a tannic acid.

6. A process according to claim 1, wherein said aqueous acid solution further contains at least one compound selected from the group consisting of hydrofluoric acid, borofluoric acid, hydrosilicofluoric acid and a salt of any of these.

* * * * *

UNITED STATES PATENT AND TRADEMARK OFFICE

CERTIFICATE OF CORRECTION

PATENT NO. : 6,953,647 B2
DATED : October 11, 2005
INVENTOR(S) : Tomohiro Kimura et al.

It is certified that error appears in the above-identified patent and that said Letters Patent is hereby corrected as shown below:

Title page,
Item [30], Foreign Application Priority Data, "9-33-386" should read -- 9-330386 --.
Item [56], References Cited, FOREIGN PATENT DOCUMENTS,

| | | |
|---|---|---|
| "012733 | should read | -- 54-012733 |
| 029051 | | 57-029051 |
| 062056 | | 57-062056 |
| 014841 | | 58-014841 |
| 029852 | | 01-029852 |
| 007070 | | 02-007070 |
| 034964" | | 05-034964 --; and |

OTHER PUBLICATIONS,
"CRC Handbook of", reference, "Ch mistry" should read -- Chemistry --; and "W st" should read -- Weast --; and "t al.," should read -- et al., --; and "Rubb r" should read -- Rubber --.

Column 2,
Line 8, "with" should read -- but, with --.

Column 4,
Line 25, "maybe" should read -- may be --.

Column 6,
Line 34, "be a" should read -- to be --.

Signed and Sealed this

Twenty-first Day of March, 2006

JON W. DUDAS
*Director of the United States Patent and Trademark Office*